United States Patent [19]

Kruka

[11] Patent Number: 4,498,932

[45] Date of Patent: Feb. 12, 1985

[54] PIPELINE PIG WITH RESTRICTED FLUID BYPASS

[75] Inventor: Vitold R. Kruka, Houston, Tex.

[73] Assignee: Shell Oil Company, Houston, Tex.

[21] Appl. No.: 561,497

[22] Filed: Dec. 14, 1983

[51] Int. Cl.[3] ..... B08B 9/04

[52] U.S. Cl. ..... 134/8; 15/104.06 R; 134/22.12

[58] Field of Search ..... 134/8, 22.12, 24, 166 C, 134/167 C; 15/104.06 R

[56] References Cited

U.S. PATENT DOCUMENTS

| | | | |
|---|---|---|---|
| 1,756,378 | 4/1930 | Oberhuber | 15/104.06 R |
| 2,289,109 | 7/1942 | Edwards et al. | 15/104.06 R |
| 3,403,701 | 10/1968 | Knapp et al. | 15/104.06 R X |
| 3,667,544 | 6/1972 | Allimon | 15/104.06 R X |
| 3,875,606 | 4/1975 | Landers | 15/104.06 R |
| 3,900,912 | 8/1975 | Lenz et al. | 15/104.06 R |
| 4,016,620 | 4/1977 | Powers | 15/104.06 R |
| 4,069,535 | 1/1978 | Cato | 15/104.06 R |
| 4,083,076 | 4/1978 | Girard | 15/104.06 R |
| 4,206,313 | 6/1980 | Cavoretto | 134/24 X |
| 4,411,039 | 10/1983 | Timmins et al. | 15/104.06 R |

*Primary Examiner*—Marc L. Caroff

[57] ABSTRACT

A pipeline pig is provided having a restricted fluid bypass channel which serves to bring fluid from the back of the pig to its front, the fluid agitating and suspending discrete solids such as sand or rust, or commingling with scraped paraffinic and asphaltic deposits accumulated by the pig as it moves through the line, thereby preventing the buildup of a solid bed or plug of sufficient thickness or viscosity in front of the pig so as to cause the pig to partially collapse and ride over it or to become stuck.

13 Claims, 3 Drawing Figures

FIG. 1
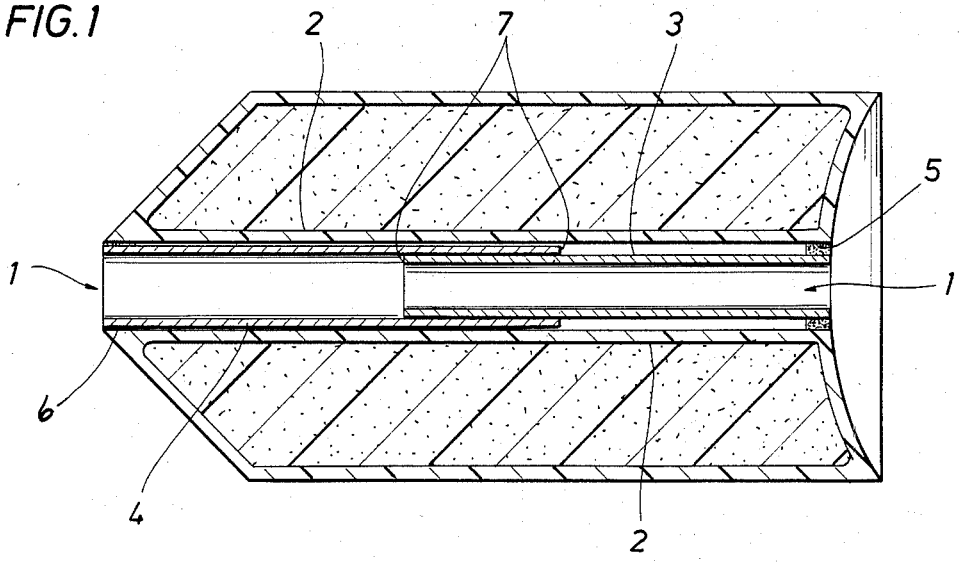
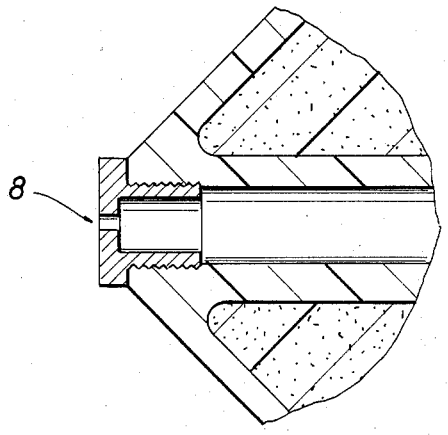
FIG. 2
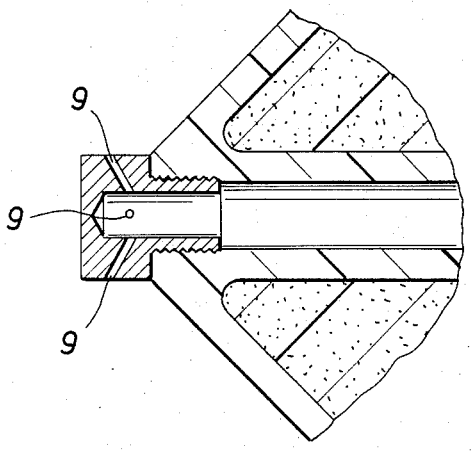
FIG. 3

PIPELINE PIG WITH RESTRICTED FLUID BYPASS

BACKGROUND OF THE INVENTION

Pigs frequently are used in cleaning pipelines or separating product batches in a pipeline. In pipelines having internal obstructions, or substantially varying diameter, there is significant risk in using a pig which may become stuck, and such risk is enormous in deepwater pipelines where the cost in lost time in recovering a stuck pig and reopening the pipeline are substantial. For such pipelines, it is attractive to use a foam pig which is capable of changing size to get around obstructions or adapt to a different pipe diameter. However, foam pigs are not without problems also, and have been known to occasionally fail. Accordingly, discrete solids such as sand or rust may build up a solid bed of sufficient thickness in front of the pig so as to cause the pig to partially collapse and ride over it. Paraffinic or asphaltic solids may build up a column in front of the pig of sufficient length so as to stop forward motion due to the column's high yield stress and effective viscosity.

Accordingly, the present invention is directed to overcoming the above-identified problems of the art by providing a novel pipeline pig which not only solves the above problems but also has other advantages as will become apparent hereinafter.

SUMMARY OF THE INVENTION

The primary purpose of the present invention is to provide a pipeline pig which has been modified to avoid failure in pipeline usage; thus, the pipeline pig of this invention avoids the accumulation of discrete solids in front of the pig as it moves through the line and the buildup of deposits which form viscous plugs in front of the pipeline pig.

These and other purposes of the present invention are realized by modifying a pipeline pig to provide a restricted fluid bypass channel which serves to bring fluids from the back of the pig to its front. There the fluid agitates and suspends discrete solids or precludes the buildup of viscous plugs, in either case preventing the failure of the pig as it attempts to pass over or around or through such barriers. Preferably, the restricted fluid bypass channel is formed with two tubes, one at least partically inserted into the other to allow for axial compression of the pipeline pig. Preferably, the pig has a cylindrical body with a concave section at one end and a conical section at the other end. More preferably, the restricted fluid bypass channel has a nozzle located at one end, the nozzle having at least one jet which may be either axially or tangentially directed.

Other purposes, distinctions over the art, advantages and features of the invention will be apparent to one skilled in the art upon review of the following.

BRIEF DESCRIPTION OF THE DRAWINGS

FIG. 1 is a sectional view of a pipeline pig modified in accordance with the present invention.

FIG. 2 is a first embodiment of a nozzle inserted in the fluid bypass channel of the invention.

FIG. 3 is a second embodiment of a nozzle incorporated into the fluid bypass channel of the invention.

DESCRIPTION OF PREFERRED EMBODIMENTS

Foamed pigs or scrapers are employed by the pipeline industry for cleaning pipelines. Commonly, the foam is polyurethane and the cell structure is principally closed. The exterior surface of the pig is usually protected by a high durometer hardness skin, usually also polyurethane. Hard bristles may be embedded in the skin for additional scraping and cleaning action.

The present invention offers an improvement to a pig, preferably a foamed pig, for cleaning solids from pipelines. The solids may be sand, rust, or the like, or paraffinic and asphaltic deposits or the like on pipe walls. The invention involves adding a restricted fluid bypass channel to the pig. The bypass channel serves to bring fluid from the back of the pig to its front. There the fluid agitates and suspends discrete solids, such as sand or rust, or commingles with scraped paraffinic and asphaltic solids, etc. accumulated by the pig as it moves through the line. In the case of discrete solids, the invention prevents the buildup of a solid bed of sufficient thickness in front of the pig so as to cause the pig to partially collapse and ride over it. In the case of paraffinic or asphaltic deposits or the like, the invention precludes the buildup of a paraffin-asphalt column in front of the pig of sufficient length so as to stop forward motion due to the high yield stress and effective viscosity of the column. In either case, the bypassed fluid is distributed throughout the solid making it like a slurry with fluid-like properties.

Having thus described the apparatus and method of the present invention, as well as its numerous advantages over the art, the following is a more detailed description thereof, given in accordance with specific reference to the drawings.

The invention can be realized by pigs as shown in FIGS. 1 to 3. FIG. 1 depicts a conventional pig, preferably a foam pig, except with a passage 1 through its center. The walls of passage 1 preferably are lined with an elastic, impervious skin 2 which is bonded to the body of the pig, preferably foam for physical protection of the foam. Optionally, at least two tubes are inserted in the passageway 1 for assuring an open passage. The rear tube 3 is smaller than the front tube 4 so that it can ride within the front tube. This allows for axial compression of the pig when exposed to pipeline pressure. The tubes are of sufficient strength so as not to collapse radially or buckle when exposed to pressure due to axial compression or bending of the pig, particularly a foam pig, when passing through elbows in a pipe. The rear tube 3 preferably is bonded to the pig at the rear 5 while the front tube 4 preferably is bonded to the pig at the front 6. The tubes preferably are oil-resistant plastic or metallic. The free tube ends 7 are preferably rounded to reduce wear due to relative motion. The passageway 1, with or without tubes 3 and 4, can be terminated by nozzles or orifices shown in FIGS. 2 and 3. FIG. 2 shows an orifice 8 which is screwed onto or otherwise fastened to the pig. FIG. 3 shows multiple jets 9 which have been screwed or otherwise fastened to the pig. The jets may be at any angle but preferably are directed slightly forward and tangentially to the pipe wall so as to create a swirling flow through the pipe sweeping the entire wall. The orifice and jet sizes are chosen so as to give a desired flow rate and pressure drop across the pig. The orifice and jet size can be easily changed as required since they are screwed on or have other removable fastening devices holding them in place.

The foregoing description of the invention is merely intended to be explanatory thereof, and various changes in the details of the described method and apparatus may be made within the scope of the appended claims without departing from the spirit of the invention.

What is claimed is:

1. A pipeline pig comprising a compressible polymeric cylindrical body having a restricted fluid bypass channel therethrough which is formed with two tubes respectively bonded to the cylindrical body at opposite ends thereof, each tube having a free end positioned within the channel, with one tube being partially inserted into the other to allow for axial compression of the pipeline pig.

2. The pipeline pig of claim 1 wherein the restricted fluid bypass channel is formed by an elastic, impervious skin.

3. The pipeline pig of claim 1 wherein the cylindrical body has a conical section at one end.

4. The pipeline pig of claim 3 wherein the cylindrical body has a concave section at the other end.

5. The pipeline pig of claim 4 wherein the restricted fluid bypass channel extends from the conical section to the concave section.

6. The pipeline pig of claim 1 wherein the restricted fluid bypass channel is axially centrally located.

7. The pipeline pig of claim 1 wherein the restricted fluid bypass channel has a nozzle located at one end.

8. The pipeline pig of claim 7 wherein the nozzle has at least one replaceable jet of selected size.

9. The pipeline pig of claim 8 wherein the jet is axially directed.

10. The pipeline pig of claim 8 wherein the jet is tangentially directed.

11. The pipeline pig of claim 1 wherein the cylindrical body is polyurethane foam covered with a high durometer hardness skin of polyurethane.

12. A method for cleaning a pipeline comprising:

inserting a pig into the pipeline, said pig being a compressible polymeric cylindrical body having a restricted fluid bypass channel therethrough;

applying fluid pressure to the pig to force the pig through the pipeline;

passing a limited amount of fluid through the restricted fluid bypass channel; and allowing the pig to axially compress by forming the bypass channel with two tubes respectively bonded to the cylindrical body at opposite ends thereof, each tube having a free end positioned within the channel, with one tube being partially inserted into the other tube.

13. The method of claim 12 wherein the fluid passing through the bypass channel is tangentially directed at the walls of the pipe.

* * * * *